US006757937B2

(12) United States Patent
Salice

(10) Patent No.: US 6,757,937 B2
(45) Date of Patent: Jul. 6, 2004

(54) APPARATUS TO MOUNT A SUPPORT RAIL OF A DRAWER GUIDE TO A WALL OF A PIECE OF FURNITURE

(75) Inventor: Luciano Salice, Como (IT)

(73) Assignee: Arturo Salice S.p.A., Novedrate (IT)

( * ) Notice: Subject to any disclaimer, the term of this patent is extended or adjusted under 35 U.S.C. 154(b) by 0 days.

(21) Appl. No.: 10/266,932

(22) Filed: Oct. 9, 2002

(65) Prior Publication Data

US 2004/0068834 A1 Apr. 15, 2004

(51) Int. Cl.[7] ..... E05D 15/00

(52) U.S. Cl. ..... 16/94 R; 16/96 R

(58) Field of Search ..... 16/94 R, 96 R, 16/DIG. 39, 242, 383; 312/334.4, 334.22, 334.1, 334.7, 334.13, 334.14, 334.19, 334.21, 334.35, 334.44, 348.2; 248/220.21, 220.31, 220.41, 220.42, 220.43, 231.9

(56) References Cited

U.S. PATENT DOCUMENTS 4,244,546 A * 1/1981 Mertes et al. ..... 248/258
5,039,181 A * 8/1991 Lautenschlager ..... 312/334.7
5,163,774 A * 11/1992 Lautenschlager ..... 403/245
5,306,080 A * 4/1994 Lautenschlager et al. ..... 312/334.5
5,349,723 A 9/1994 Domenig ..... 16/94 R
5,352,034 A * 10/1994 Held et al. ..... 312/334.27
5,359,752 A 11/1994 Domenig ..... 16/94 R
6,367,900 B1 * 4/2002 Woerner ..... 312/334.5

FOREIGN PATENT DOCUMENTS

DE 2809930 A1 * 9/1979
GB 1447036 * 8/1976

* cited by examiner

*Primary Examiner*—Chuck Y. Mah
(74) *Attorney, Agent, or Firm*—Jacobson Holman PLLC

(57) ABSTRACT

An apparatus to mount a support rail of a drawer guide to a wall of a piece of furniture, the apparatus having a base plate for mounting to the wall of the piece of furniture and a connecting piece, connectable to the rear end of the support rail, which is guided in a limitedly displaceable but not raisable manner on the base plate. The base plate has at least one upper groove and a cam disposed beneath the groove, and the connecting piece includes a plate-like part with an elongate aperture therein that is generally parallel with an upper edge of the plate-like part. The upper edge of the plate-like part fits within the upper groove of the base plate, and the cam projects through the elongate aperture of the plate-like part. A fastening element such as a screw can be screwed into a bore of the cam to retain the connecting piece against the base plate.

18 Claims, 1 Drawing Sheet

APPARATUS TO MOUNT A SUPPORT RAIL OF A DRAWER GUIDE TO A WALL OF A PIECE OF FURNITURE

BACKGROUND OF THE INVENTION

1. Field of the Invention

The invention relates to an apparatus to mount a support rail of a drawer guide to a wall of a piece of furniture, comprising a base plate having means for mounting to a wall of a piece of furniture on which a connecting piece connectable to the rear end of the support rail is guided in a limitedly displaceable, but not raisable manner.

2. Description of the Related Art

An apparatus of the kind first named is known from U.S. Pat. No. 5,349,723 A in which two top and bottom tongues respectively are bent out of the base plate, with the ends of said tongues being angled with respect to one another to form guide grooves, with the upper and lower edges, which are parallel to one another, of a plate-like part of the connecting piece being guided in a transversely displaceable manner in the grooves. Furthermore, resilient tongues are bent out of the base plate which are supported in a force fitting manner on the upper and lower edges of the plate-like part of the connecting piece. The base plate is provided with an elongate aperture between the grooves, with a cam engaging into said elongate aperture and being. arranged at the end of a resilient tongue cut out of the plate-like part. The side edges of the base plate are provided at both sides of the elongate aperture with chamfered ramps such that the cam is resiliently forced back on the insertion of the plate-like part of the connecting piece into the guide grooves until it snaps into the elongate aperture by which the transverse displaceability of the connecting piece relative to the base plate is limited.

A further apparatus of the first named kind is known from U.S. Pat. No. 5,359,752 A which essentially differs from that of U.S. Pat. No. 5,349,723 only in that the tongues resiliently bent out of the base plate are provided with toothing arrangements which engage into mating toothing arrangements at the upper and lower edges of the plate-like part of the connecting piece.

SUMMARY OF THE INVENTION

It is the object of the invention to provide an apparatus of the kind first named which can be manufactured and mounted more easily than the known kinds.

This object is solved in accordance with the invention in that the connecting piece has a plate-like part, which is guided between at least one upper groove of the base plate into which the upper edge of the plate-like part engages and a cam of the base plate disposed beneath the groove, said base plate engaging into an elongate aperture of the plate-like part parallel to the upper edge, and in that a screw can be screwed into the cam, the head of said screw engaging over the edges of the elongate aperture.

The securing of the base plate, for example to the rear wall of a cupboard or of a chest of drawers, takes place by mounting screws or by pins engaging into bores of the rear wall. For the mounting of the connecting piece, the upper edge of the plate-like part is inserted into the groove by a slight pivoting of the plate-like part to the front and is subsequently pivoted toward the base plate in a manner such that the cam engages into the elongate aperture. A screw is then screwed into a tapped bore of the cam in a manner such that the head of the screw engages over the edges of the elongate aperture.

A slight clearance expediently remains between the side edges of the elongate aperture and the head of the screw when the screw is tightly screwed into the cam such that the connecting piece can be displaced in the transverse direction by its plate-like part. The edges of the elongate aperture can be provided with stepped cut-outs in which the head of the screw lies such that the screw head does not project beyond the plate-like part of the connecting part at all or only slightly. The connecting piece is thereby guided transversely displaceably on the base plate such that the plate-like part of the connecting part is supported between the upper groove and the cam guided in the elongate aperture.

Provision is made in accordance with another embodiment that the cam of the base plate is lower than the edges of the elongate aperture such that the connecting piece can be braced with the base plate after its lateral adjustment via the plate-like part by tightening the screw.

Provision is made in accordance with a preferred embodiment that the groove is formed by the mouth of at least one hook at the base plate, said hook engaging over the upper edge of the plate-like part of the connecting piece.

The base plate can be provided with at least one lower, shoulder shaped projection on which the lower edge of the plate-like part is supported, said lower edge being parallel to the upper edge. With this embodiment, the plate-like part of the connecting piece is guided between the upper groove and the lower, shoulder-shaped projection. To avoid double fittings and to compensate for production tolerances, the width of the cam is formed in this embodiment such that it engages between the upper and lower edges of the elongate aperture with clearance and only limits the path of the lateral displacement of the connecting piece relative to the base plate.

Provision is made in another aspect of the invention that the plate-like part of the connecting piece carries a right-angled limb onto which the support rail can be placed.

The limb is expediently provided at both sides with grooves into which webs engage which are formed by a cut-out of a box-shaped section part of the support rail.

BRIEF DESCRIPTION OF THE DRAWINGS

An embodiment of the invention will be described in more detail in the following with reference to the drawing, in which are shown.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
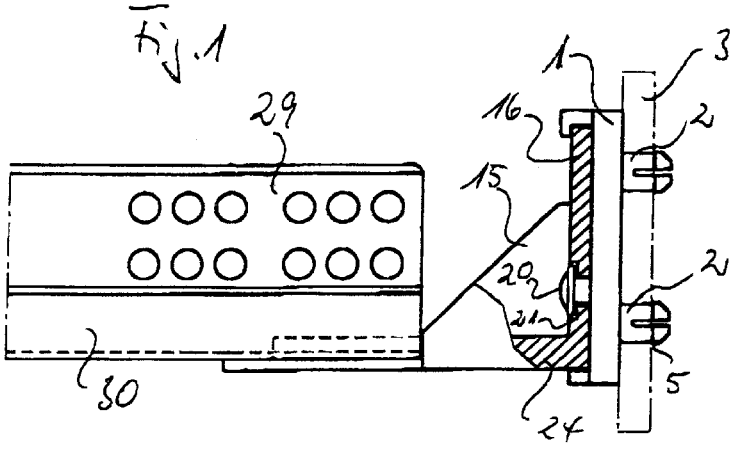
FIG. 1: a side view of a support plate which is connected to the rear wall of a cupboard or of a chest of drawers and on which a connecting piece connected to a support rail is transversely displaceably connected, said connecting piece being shown in a partially sectioned manner.
Figure 3:
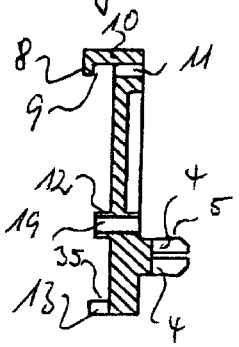
FIG. 3: a section through the base plate along the line III—III in FIG. 2.
Figure 2:
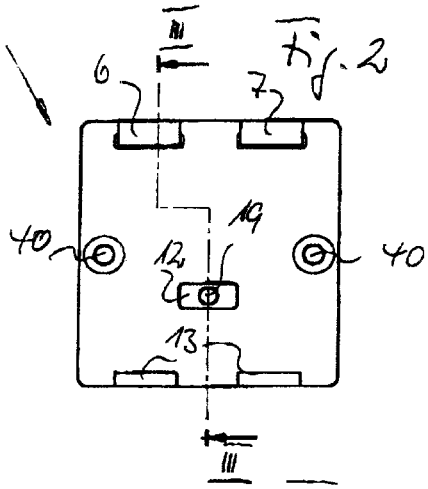
FIG. 2: a plan view of the base plate in accordance with FIG. 1.

A base plate 1 can be seen from FIG. 1 which is provided in one piece on its rear side with slit spigots 2 which, for the securing of the base plate 1 to a rear wall 3 of a cupboard or of a chest of drawers, engage into bores of this rear wall. The parts 4 of the spigots separated by intersecting slits are chamfered at their ends such that they can be easily pressed into the bores in which the slit parts are compressed since the chamfered ends run into a flange widening the spigots 2 or into widening shoulders 5 which spring open in the manner visible from FIG. 1 when they have passed through the bores such that the spigots 2 are latched in the bores in a hook-like manner. To ensure the required elasticity of the spigots 2, the base plate 1 expediently consists of a plastic injection molded part.

The base plate 1 has at its upper rim and spaced from one another two hook-like parts 6, 7 which form guide grooves 9 between the angled webs 8 forming the hooks and the front side of the base plate 1. To avoid unwanted difficulties in the molding process, the base plate 1 is provided with openings 11 bounding the right-angled webs 10 of the hooks 6, 7. The base plate 1 carries a rising cam 12 rectangular in cross-section beneath the hooks 6, 7. The cam 12 could also have a round cross-section. The base plate 1 supports two shoulder-like projections 13 arranged spaced apart from one another at its lower edge parallel to the upper edge.

Figure 4:
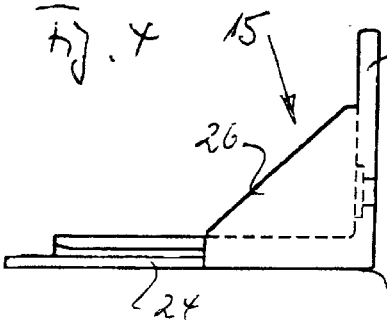
FIG. 4: a side view of the connecting piece.
Figure 5:
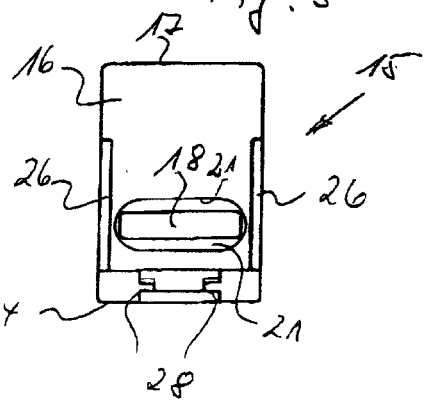
FIG. 5: a front view of the connecting piece in accordance with FIG. 4.

The connection piece 15 visible from FIGS. 1, 4 and 5 is transversely displaceably guided on the base plate 1. The connecting piece 15 consists of a plate-like part 16 whose upper edge 17 can be inserted into the grooves 9 of the hooks 6, 7 under a slight tilt. The plate-like part 16 is provided with an elongate aperture 18 parallel to the upper edge 17. After the insertion of the upper edge 17 into the grooves 9, the plate-like part 16 can be hinged to the surface of the base plate 1 in the manner visible from FIG. 1 such that the cam 12 engages into the elongate aperture 18. The cam 12 is provided with a bore 19 into which a retaining screw 20 can be screwed, with the edge of its head engaging over the edge of the elongate aperture 18 which lies in a peripheral step 21.

Provision is made in accordance with a preferred embodiment that the cam 12 projects over the stepped edge 21 of the elongate aperture 18 such that the head of the securing screw 20 is supported on the cam 12 in the tightly screwed-in state and such, that a slight clearance remains between the head and the edge 21 of the elongate aperture 18 over which the head engages.

The plate-like part 16 of the connecting piece 15 is provided at its lower end with a right-angled limb 24 such that the connecting piece 15 has the form of a bracket. The connecting piece 15 can likewise consist overall of a plastic injection molded part. It is buttressed by lateral triangular reinforcement parts 26 between the plate-like part 16 and the limb 24. The part of the limb 24 projecting over the reinforcement parts 26 is provided with lateral grooves 28 which serve the holding of the rear end of the support rail 29. The lower box-shaped section part 30 of the support rail 29 is provided at its lower side with a rectangular cut-out in the manner such that lateral web parts are maintained which engage into the grooves 28 for the securing of the support rail 29 to the connecting piece 15.

The lower edge 34 of the plate-like part 16 parallel to the upper edge 17 can be supported, in accordance with a preferred embodiment, on the upper flanks 35 of the shoulder-like projections 13 to increase the stability. With this embodiment, the cam 12 is then expediently arranged in the elongate aperture 18 in a manner such that it is not supported on the edges of the elongate aperture.

The connecting piece 15 serves the securing of the rear end of the support rails of a drawer guide. The front ends of the support rails are connected in a conventional manner, not shown, to the side walls of a cupboard or of a chest of drawers.

The base plate 1 can also be connected to the rear wall of a cupboard or of a chest of drawers by securing screws, isntead of by the spigots 2, said screws engaging through bores 40 of the base plate 1.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. An apparatus for mounting a support rail of a drawer guide to a wall of a piece of furniture, comprising:

a base plate for being mounted to a furniture wall, said base plate having at least one upper groove and a cam disposed beneath said groove;

a connecting piece having a plate-like part with an elongate aperture therein that is generally parallel with an upper edge of said plate-like part, said upper edge fitting within said base plate upper groove and said cam extending into said elongate aperture when said plate-like part is generally parallel with and adjacent said base plate such that said connecting piece is transversely displaceable along said elongate aperture, said connecting piece being connectable to a rear end of a drawer guide support rail; and a fastening element secured to said cam to retain said plate-like part of said connecting piece against said base plate.

2. The apparatus as set forth in claim 1, wherein said elongate aperture has a stepped lateral edge and said fastening element is a screw with a widened head portion that extends over said edge, said cam projecting beyond an outer surface of said stepped edge such that, when said screw is tightly secured in said cam, said head portion engages said cam and a clearance remains between the outer surface of said stepped edge and said head portion.

3. The apparatus as set forth in claim 2 wherein, when said screw is tightly secured in said cam, said head portion is generally flush with an outer surface of said plate-like part.

4. The apparatus as set forth in claim 2, wherein said base plate further includes at least one shoulder-like projection adjacent a lower edge thereof, a lower edge of said plate-like part being supported on said shoulder-like projection.

5. The apparatus as set forth in claim 1, wherein said fastening element is a screw with a widened head portion and a length of said cam is less than a thickness of said plate-like part such that, when said screw is tightly secured in said cam, said head portion engages and braces said connecting piece against said base plate.

6. The apparatus as set forth in claim 1, wherein said groove is formed by an L-shaped projection extending from said base plate to define a hooked portion at a free end thereof, said upper edge of said plate-like part fitting between said base plate and said hooked portion.

7. The apparatus as set forth in claim 1, wherein said base plate further includes at least one shoulder-like projection adjacent a lower edge thereof, a lower edge of said plate-like part being supported on said shoulder-like projection.

8. The apparatus as set forth in claim 7, wherein said cam extending in said elongate aperture is unsupported by edges thereof.

9. The apparatus as set forth in claim 1, wherein said plate-like part supports a generally perpendicularly extending limb for connection to a support rail.

10. An apparatus for mounting a support rail of a drawer guide to a support surface, comprising:

a base plate mounted to the support surface, said base plate having at least one upper groove and a cam disposed beneath said groove;

a connecting piece having a plate-like part with an elongate aperture therein that is generally parallel with an upper edge of said plate-like part, said upper edge fitting within said base plate upper groove and said cam extending into said elongate aperture when said plate-like part is generally parallel with and adjacent said base plate such that said connecting piece is transversely displaceable along said elongate aperture, said connecting piece being connected to a rear end of a drawer guide support rail; and a fastening element secured to said cam as extended into said elongate aperture to retain said plate-like part of said connecting piece against said base plate.

11. The apparatus as set forth in claim 10, wherein said elongate aperture has a stepped lateral edge and said fastening element is a screw with a widened head portion that extends over said edge, said cam projecting beyond an outer surface of said stepped edge such that, when said screw is tightly secured in said cam, said head portion engages said cam and a clearance remains between the outer surface of said stepped edge and said head portion.

12. The apparatus as set forth in claim 11 wherein, when said screw is tightly secured in said cam, said head portion is generally flush with an outer surface of said plate-like part.

13. The apparatus as set forth in claim 10, wherein said fastening element is a screw with a widened head portion and a length of said cam is less than a thickness of said plate-like part such that, when said screw is tightly secured in said cam, said head portion engages and braces said connecting piece against said base plate.

14. The apparatus as set forth in claim 10, wherein said groove is formed by an L-shaped projection extending from said base plate to define a hooked portion at a free end thereof, said upper edge of said plate-like part fitting between said base plate and said hooked portion.

15. The apparatus as set forth in claim 10, wherein said base plate further includes at least one shoulder-like projection adjacent a lower edge thereof, a lower edge of said plate part being supported on said shoulder-like projection.

16. The apparatus as set forth in claim 15, wherein said cam extending in said elongate aperture is unsupported by edges thereof.

17. The apparatus as set forth in claim 10, wherein said plate-like part is connected to said support rail by a limb that extends generally perpendicularly from said plate-like part.

18. The apparatus as set forth in claim 10, wherein said base plate is made of injection molded plastic and is mounted to said support surface with slit spigots that engage into bores in said support surface.

* * * * *